US009014582B2

(12) United States Patent
Toriyabe

(10) Patent No.: US 9,014,582 B2
(45) Date of Patent: Apr. 21, 2015

(54) IMAGE FORMING APPARATUS WHICH CORRECTS AN EXTRACTED COLOR

(75) Inventor: Hiroyuki Toriyabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 13/488,360

(22) Filed: Jun. 4, 2012

(65) Prior Publication Data

US 2013/0011153 A1 Jan. 10, 2013

(30) Foreign Application Priority Data

Jul. 8, 2011 (JP) ..... 2011-152343

(51) Int. Cl.
*G03G 15/00* (2006.01)
*G03G 15/01* (2006.01)

(52) U.S. Cl.
CPC ..... *G03G 15/5058* (2013.01); *G03G 15/0189* (2013.01); *G03G 2215/0129* (2013.01); *G03G 2215/0164* (2013.01)

(58) Field of Classification Search
USPC ..... 399/66, 49
See application file for complete search history.

(56) References Cited

U.S. PATENT DOCUMENTS

2005/0244177 A1* 11/2005 Iwakawa ..... 399/49
2010/0231936 A1 9/2010 Nagai
2010/0247124 A1* 9/2010 Aoki et al. ..... 399/49

FOREIGN PATENT DOCUMENTS

JP 2006-174240 A 6/2006
JP 2010-213012 A 9/2010

* cited by examiner

*Primary Examiner* — Quana M Grainger
(74) *Attorney, Agent, or Firm* — Fitzpatrick, Cella, Harper & Scinto

(57) ABSTRACT

An image forming apparatus comprises: an extraction unit that analyzes an input print job and extracts a color used in a plurality of pages of the print job; a forming unit configured to form a patch image of the color extracted by the extraction unit; a determining unit configured to measure the patch image formed by the forming unit and to determine an amount of color fluctuation from a reference value for the extracted color; and a correction unit configured, when printing the input print job, to correct the extracted color by using the amount of color fluctuation determined by the determining unit.

10 Claims, 11 Drawing Sheets

| Process Color | Page1 | Page2 | … | Page9 | Page10 |
|---|---|---|---|---|---|
| (40, 40, 50, 10) | ○ | ○ | … | ○ | ○ |
| (10, 70, 20, 0) | ○ | × | … | × | ○ |
| (10, 10, 20, 20) | × | ○ | … | ○ | × |
| … | … | … | … | … | … |

| Named Color | Page1 | Page2 | … | Page9 | Page10 |
|---|---|---|---|---|---|
| PANTONE 9201 C | ○ | ○ | … | ○ | ○ |
| DIC 19s | ○ | × | … | × | × |
| PANTONE Green | × | ○ | … | ○ | × |
| … | … | … | … | … | … |

IMAGE FORMING APPARATUS WHICH CORRECTS AN EXTRACTED COLOR

BACKGROUND OF THE INVENTION

1. Field of the Invention

The present invention relates to an image forming apparatus that receives image data and performs print processing, an image forming method and a computer-readable medium. More particularly, the present invention relates to calibration control for stabilizing the colors of a printed image.

2. Description of the Related Art

In recent years, demand is increasing for direct imaging printers that do not require the use of plates used in offset printing or the like. Direct imaging printers are widely used to respond to the needs for reduction in print time and printing a large number of copies, as well as responding to environmental issues such as discarding of misprinted pieces of paper. Among direct imaging printers more widely used are inkjet printers, which are advantageous in terms of cost and suitable for electrophotographic printing, and electrophotographic printers, which are highly productive and produce printed items closer to offset printing quality. Under the circumstances, direct imaging printers serving as an alternative for conventional offset printing and photography are required to provide color stability for an image formed on paper, which is one of the most important functions.

In order to ensure color stability, techniques regarding color stabilization control (calibration processing) have hitherto been proposed. As an example of color stabilization control in an electrophotographic image processing apparatus, an image forming apparatus has been proposed in which an image on output paper where a patch pattern has been formed is read by a printer unit and image control is performed based on the read result. In this image forming apparatus, the apparatus for reading the patch pattern can be, for example, a reader unit connected to the printer unit, an external color/density meter, or a post-fixing spectral sensor housed in the printer unit. Also, the image forming apparatus forms a CMYK single color tone patch or a CMYK mixed color patch, as the patch pattern. The image forming apparatus generates a one-dimensional tone correction LUT or an N-dimensional color correction LUT based on the results obtained by reading such a patch.

This calibration process, however, is for entire optimization by collectively correcting predefined colors to be corrected. Accordingly, it is not possible to selectively correct only specific colors that particularly require highly accurate correction from among the colors used in a job.

To address this, Japanese Patent Laid-Open No. 2006-174240 discloses a method for selectively correcting only specific colors. According to Japanese Patent Laid-Open No. 2006-174240, first, a print job is analyzed, and all characteristic colors used in the job are listed. Then, neighboring colors to the characteristic colors are extracted from a device profile, and a chart of the extracted colors is output. The device profile is corrected based on values read from the chart.

Japanese Patent Laid-Open No. 2010-213012 discloses another correction method. Japanese Patent Laid-Open No. 2010-213012 enables a user to designate colors that he/she wants to selectively correct. If it is determined, as a result of analysis of a PDL job when printing a job, that the designated colors are used in the job, the image forming apparatus carries out calibration on only the designated colors.

The colors frequently used across a plurality of pages constituting a print job particularly require highly accurate correction. Specific examples that require highly accurate correction are objects that appear in most or all pages of a job, such as "tab marks" printed on page edges of an instruction manual or the like in order to indicate the segments of chapters, and "company logos" printed on page corners of a catalog or the like.

However, with the technique disclosed in Japanese Patent Laid-Open No. 2006-174240, all characteristic colors used in a job are listed, but no consideration is given to the use frequency across a plurality of pages, so it cannot be said that only colors that require highly accurate correction are extracted. Furthermore, only characteristic colors are extracted, and it is not possible to extract major colors composed of CMYK process colors.

Also, the technique disclosed in Japanese Patent Laid-Open No. 2010-213012 does not perform color extraction based on the analysis of a PDL job, and a print operator manually inputs information about major colors to be corrected. Accordingly, the author of data has to know detailed information about CMYK and RGB values of major colors, or the names of predefined characteristic colors. Also, in the case where the author of data and the print operator are different as is often the case in the POD market, the detailed information about major colors needs to be properly communicated.

In view of the above, the present invention provides a technique with which major colors that require highly accurate correction can be extracted more accurately and more easily.

SUMMARY OF THE INVENTION

According to one aspect of the present invention, there is provided an image forming apparatus comprising: an extraction unit that analyzes an input print job and extracts a color used in a plurality of pages of the print job; a forming unit configured to form a patch image of the color extracted by the extraction unit; a determining unit configured to measure the patch image formed by the forming unit and to determine an amount of color fluctuation from a reference value for the extracted color; and a correction unit configured, when printing the input print job, to correct the extracted color by using the amount of color fluctuation determined by the determining unit.

According to another aspect of the present invention, there is provided an image forming method comprising: analyzing an input print job and extracting a color used in a plurality of pages of the print job; forming a patch image of the color extracted in the extraction step; measuring the patch image formed in the forming step and determining an amount of color fluctuation from a reference value for the extracted color; and when printing the input print job, correcting the extracted color by using the amount of color fluctuation determined in the determining step.

According to another aspect of the present invention, there is provided a computer-readable medium storing a program for causing a computer to function as: an extraction unit configured to analyze an input print job and extracts a major color used in a plurality of pages of the print job; a forming unit configured to form a patch image of the color extracted by the extraction unit; a determining unit configured to measure the patch image formed by the forming unit and to determine an amount of color fluctuation from a reference value for the extracted color; and a correction unit configured, when printing the input print job, to correct the extracted color by using the amount of color fluctuation determined by the determining unit.

According to the present invention, it is possible to provide a technique with which, for each job, major colors that require highly accurate correction can be extracted more accurately and more easily.

Further features of the present invention will become apparent from the following description of exemplary embodiments (with reference to the attached drawings).

DESCRIPTION OF THE EMBODIMENTS

First Embodiment

System Configuration

Figure 1:
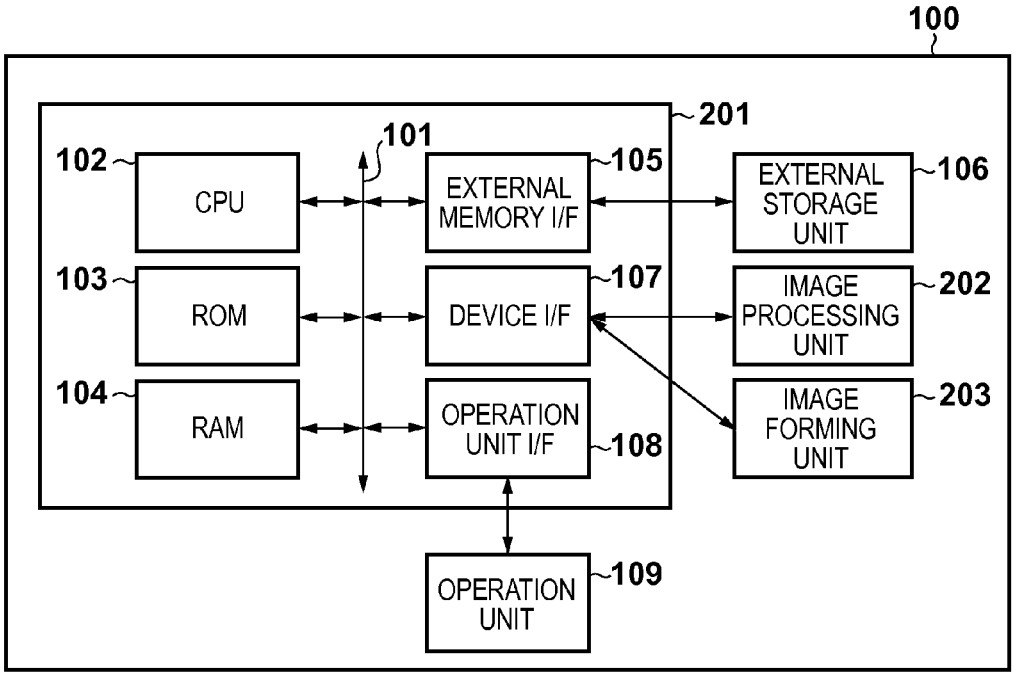
FIG. 1 is a block diagram of an entire image forming apparatus.

FIG. 1 is a block diagram showing the entirety of an electrophotographic image forming apparatus 100 according to a first embodiment of the present invention. The image forming apparatus 100 includes an image forming unit 203 and an image processing unit 202. The image processing unit 202 generates bitmap image information, and the image forming unit 203 forms an image on a recording medium based on the generated bitmap image information. An example of the image forming apparatus can be an MFP (Multifunction Peripheral).

A controller unit 201 is connected to a scanner (not shown) serving as an image input apparatus and the image processing unit 202 serving as an image output apparatus. Also, the controller unit 201 is a controller for performing input and output of image information and device information by connecting to a network (not shown) such as a LAN or public line.

A system bus 101 is composed of a PCI bus or high-speed bus such as IEEE 1394. In FIG. 1, only devices related to the present embodiment are shown. It is needless to say that a network connection I/F and a scanner I/F that are necessary in the MFP are connected to the system bus 101.

A CPU 102 functions as a controller that performs overall control of the digital multifunction peripheral. A RAM 104 is a system work memory for the CPU 102 to perform operations, and also used as an image memory for temporarily storing image data. A ROM 103 is used as a boot ROM and in which a boot program for the digital multifunction peripheral is stored.

An external memory I/F 105 is an external memory I/F such as a HDD, and is capable of reading/writing data stored in an external storage unit 106. The external storage unit 106 is an external memory such as a HDD, DDR3 memory or NAND Flash memory. The external storage unit 106 is a storage unit that stores system software, image data, personal data such as address books, and patch patterns necessary for the present embodiment.

A device I/F 107 is capable of performing communication with the image processing unit 202 and the image forming unit 203, issuing print execution commands, transferring image data, and reading engine status. An operation unit I/F 108 connects an operation unit 109 and the controller unit 201. The operation unit 109 can be anything such as a unit composed only of a switch and an LED or a unit including a touch panel LCD display unit. Information input through the operation unit 109 is conveyed to the CPU 102 via the operation unit I/F 108, where required processing is performed and information is displayed on a display unit (not shown) provided in the operation unit 109.

Processing Flow

Figure 2:
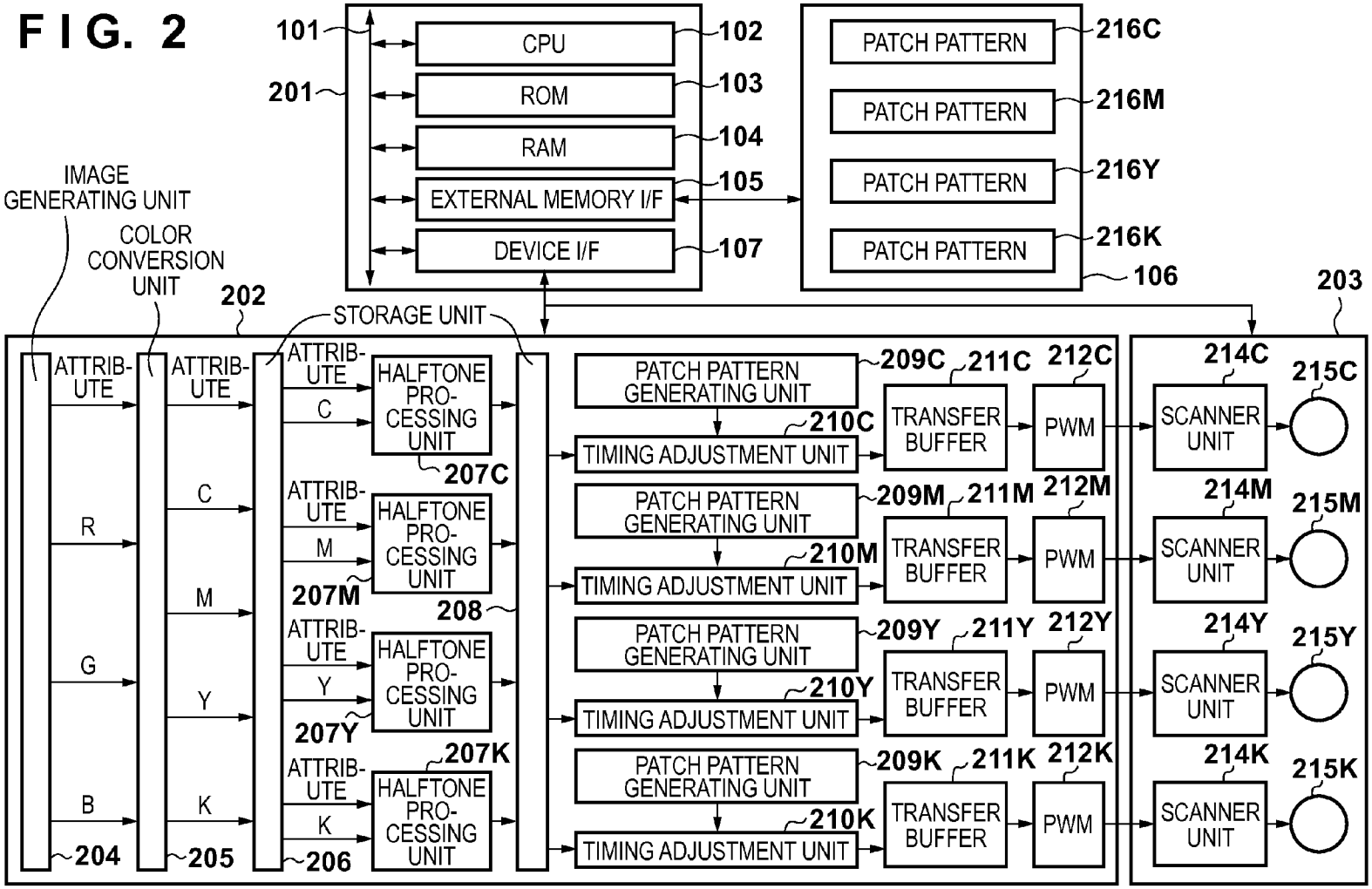
FIG. 2 is a diagram illustrating the configuration of each block involved in creating electrostatic latent images in the image forming apparatus.

Processing performed by the image processing unit 202 of the color image forming apparatus will be described next with reference to FIG. 2. FIG. 2 is a diagram illustrating the configuration of each block involved in creating electrostatic latent images in the image forming apparatus.

An image generating unit 204 generates raster image data that can be print processed, based on print data received from a computer apparatus (not shown) or the like connected via a network or the like, and outputs, for each pixel, the raster image data as RGB data and attribute data describing data attributes of each pixel. The image generating unit 204 may be configured to handle, instead of image data received from a computer apparatus or the like, image data from a reading unit provided in the color image forming apparatus. As used herein, the reading unit includes at least a CCD (Charge Coupled Device) or a CIS (Contact Image Sensor). It is also possible to provide a processing unit that performs predetermined image processing on the read image data. Alternatively, rather than being inside the color image forming apparatus, data may be received from the reading unit via an interface (not shown).

A color conversion unit 205 converts the RGB data to CMYK data so as to conform to the toner colors of the image forming unit 203, and stores the CMKY data and attribute data in a storage unit 206. The storage unit 206 is a first storage unit provided in the image processing unit 202, and temporarily stores raster image data on which print processing is to be performed. The storage unit 206 may be configured with a page memory that stores a single page worth of image data or may be configured as a band memory that stores multiple lines worth of data.

Halftone processing units 207C, 207M, 207Y and 207K perform γ correction and halftone processing on the attribute data and respective color data output from the storage unit 206. γ correction refers to processing of density correction for adjustment to attain ideal tone characteristics. The halftone processing units can have a specific configuration that performs screen processing or error diffusion processing.

Screen processing is for obtaining N-valued data by using a plurality of predetermined dither matrices and input image data. Error diffusion processing is a process in which input image data is compared with a predetermined threshold value so as to convert the input image data to N-valued data, and the difference between the input image data and the threshold value is diffused to surrounding pixels on which conversion to N-valued data is to be subsequently performed.

A second storage unit 208 provided in the image forming apparatus stores N-valued data resulting from the processing by the halftone processing units 207C, 207M, 207Y and 207K.

Patch pattern generating units 209C, 209M, 209Y and 209K are patch pattern generating units of respective colors, and generate patch patterns that require density correction and transfer the patterns to transfer buffers, which will be described later. A patch pattern can be generated by the controller unit 201 selecting an optimal patch pattern and reading a screen pattern pre-stored in the external storage unit 106. Alternatively, the patch pattern can be generated by an internal logic.

Timing adjustment units 210C, 210M, 210Y and 210K are timing adjustment units configured to synchronize the N-valued data from the storage unit 208 and data output timings of the patch pattern generating units 209 with the operation of the image forming unit 203.

Transfer buffers 211C, 211M, 211Y and 211K are transfer buffers for temporarily holding output data from the timing adjustment units 210.

Pulse width modulations (PWMs) 212 convert the color image data output from the corresponding transfer buffers to exposure times of scanner units 214C, 214M, 214Y and 214K. The converted image data are output from the scanner units 214 of the image forming unit 203 as respective color images 215C to 215K.

Patch patterns 216C, 216M, 216Y and 216K are patch patterns used in density correction. Different kinds of patterns corresponding to the number of tones and the halftone processing of the halftone processing units 207C, 207M, 207Y and 207K have been prepared in the external storage unit 106. These patterns are respectively read by the patch pattern generating units 209C, 209M, 209Y and 209K of the image processing unit 202 via the device I/F 107.

In this description, the external storage unit 106, the first the storage unit 206, the second the storage unit 208 and the transfer buffers 211 are configured as separate units, but they may be configured as a common storage unit provided in or outside the image forming apparatus.

The image forming unit 203 drives exposure light according to the exposure times processed by the image processing unit 202, forms electrostatic latent images, and develops the electrostatic latent images to form single-color toner images. The single-color toner images are superimposed to form a multicolor toner image, the multicolor toner image is transferred onto a medium (storage medium) 11 such as paper, and the multicolor toner image on the medium 11 is fixed.

Configuration of Image Forming Unit

Operations of the image forming unit 203 of the electrophotographic image forming apparatus 100 will be described next with reference to FIG. 3. The image forming unit 203 is configured to form electrostatic latent images with exposure light illuminated based on the exposure time obtained through conversion by the image processing unit 202, develop the electrostatic latent images to form single-color toner images, superimpose the single-color toner images to form a multicolor toner image, transfer the multicolor toner image onto the medium 11 and fix the multicolor toner image on the medium 11. The image forming unit 203 of the present embodiment includes a paper feeder unit 21, photosensitive drums 22Y to 22K, injection charging units 23Y to 23K, toner cartridges 25Y to 25K, development units 26Y to 26K, an intermediate transfer member 27, a transfer roller 28, a cleaning unit 29, a fixing unit 30, a density sensor 41 and a spectral sensor 42.

The photosensitive drums (photosensitive members) 22Y to 22K are each formed by applying an organic photoconductive layer onto the outer periphery of an aluminum cylinder. The photosensitive drums are rotated by the driving force transmitted from a drive motor (not shown), and the drive motor causes the photosensitive drums 22Y to 22K to rotate counterclockwise in response to an image forming operation.

As temporary charging units, four injection charging units 23Y to 23K for charging the respective photosensitive members of yellow (Y), magenta (M), cyan (C) and black (K) are provided in each station. Furthermore, the injection charging units are respectively provided with sleeves 23YS, 23MS, 23CS and 23KS.

Exposure light applied to each photosensitive drum is transmitted from a corresponding one of scanner units 24Y, 24M, 24C and 24K so as to selectively expose the surface of the photosensitive drums of respective colors, whereby electrostatic latent images are formed.

As development units, four development units 26Y, 26M, 26C and 26K that develop color images (Y, M, C, K) are provided in each station in order to visualize the electrostatic latent images. The development units are respectively provided with sleeves 26YS, 26MS, 26CS and 26KS. Each development unit has been detachably attached.

The intermediate transfer member 27, which is in contact with the photosensitive drums 22Y to 22K, rotates clockwise during image formation along with the rotation of the photosensitive drums 22Y to 22K, whereby single-color toner images are transferred. After that, the transfer roller 28 comes into contact with the intermediate transfer member 27 and sandwiches and conveys the medium 11, and then the multicolor toner image on the intermediate transfer member 27 is transferred onto the medium 11.

The transfer roller 28 is in contact with the medium 11 at a position indicated by 28*a* during transfer of the multicolor toner image onto the medium 11 and is moved away to a position indicated by 28*b* after print processing. The fixing unit 30 is for fusing and fixing the transferred multicolor toner image while the medium 11 is conveyed, and includes a fixing roller 31 that heats the medium 11 and a pressure roller 32 for bringing the medium 11 into pressure contact with the fixing roller 31 as shown in FIG. 3. The fixing roller 31 and the pressure roller 32 are hollow and respectively houses heaters 33 and 34 therein. In other words, the medium 11 holding the multicolor toner image is conveyed by the fixing roller 31 and the pressure roller 32, during which time heat and pressure are applied to fix the toner to the surface.

The medium 11 having the toner image fixed thereon is subsequently discharged to a discharge tray (not shown) by a discharge roller (not shown), and then the image forming operation ends. The cleaning unit 29 is for clearing toner remaining on the intermediate transfer member 27. Waste toner produced as a result of the multicolor (four-color) toner image formed on the intermediate transfer member 27 being transferred onto the medium 11 is accumulated in a cleaner container provided in the cleaning unit 29.

Figure 3:
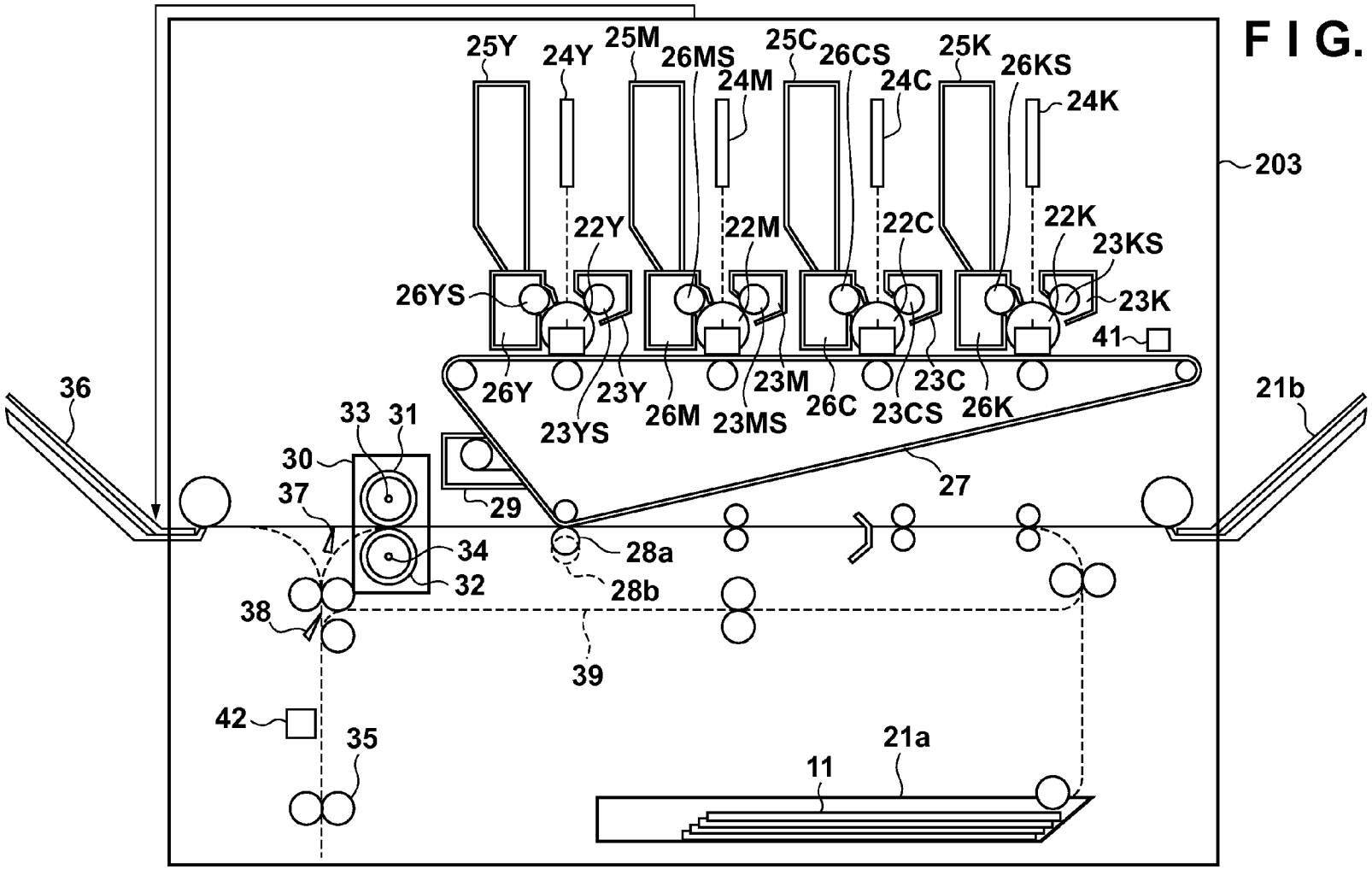
FIG. 3 is a cross-sectional view of an image forming unit.

The density sensor 41 is disposed facing the intermediate transfer member 27 in the image forming apparatus shown in FIG. 3, and measures the density of the toner patch formed on the surface of the intermediate transfer member 27. The density sensor 41 cannot make distinctions between colors of toner on the intermediate transfer member 27. Accordingly, a tone patch of single-color toner is formed on the intermediate transfer member 27. After that, the density data is fed back to a calibration table with which the density/tone characteristics of the image processing unit 202 are corrected, as well as to various process conditions of the image forming unit 203.

In the image forming unit 203 shown in FIG. 3, the spectral sensor 42 is disposed downstream of the fixing unit 30 provided along a medium conveyance path so as to face the image forming side of the medium 11. In other words, the spectral sensor is disposed along the conveyance path extending from where paper in the image forming apparatus is subjected to fixing to where the paper is discharged. Then, the patch of mixed colors that has been formed and fixed onto the medium 11 is detected and measured to obtain spectral values. As used herein, spectral values refer to the values obtained from spectral reflection coefficients by measuring the patch, such as for example, the density values, reflection coefficients, luminance values, L*a*b* values and XYZ values of the patch. Disposing the spectral sensor in the image forming apparatus 100 enables automatic detection before the fixed image is discharged to a discharge unit 36. Reading the color-mixed patch image that has been fixed enables the accuracy of color matching to be improved, and fluctuations in multiple colors that cannot be matched using only single-color patches can be corrected.

In the case where the color-mixed patch is printed only on one side of the medium 11 and the printed item is discharged, the medium 11 ejected from the fixing unit 30 after the image has been fixed is conveyed in the direction of an inversion roller 35 by moving a flapper 37 provided immediately downstream of the fixing unit 30. Then, spectral values of the color-mixed patch are measured by the spectral sensor 42 provided along the double-side printing conveyance path. Subsequently, after the leading edge of the medium 11 has reached the inversion roller 35, the inversion roller 35 is rotated in the reverse direction. After that, a double-side printing flapper 38 is moved in the direction of the discharge unit 36, and the medium 11 is thereby discharged to the discharge unit 36. On the other hand, in the case where the color-mixed patch is printed on both sides of the medium 11 and the printed item is discharged, the same processing as that in the case of single-side printing is performed until the inversion roller 35 is rotated in the reverse direction, and the double-side printing flapper 38 is moved in the direction of a double-side printing conveyance path 39, and the medium 11 is thereby conveyed to the double-side printing conveyance path 39.

It should be noted that the arrangement of the constituent elements of the image forming unit and the flow of operations illustrated herein are merely an example, and other constituent elements may be provided.

Processing Flow

Figure 4:
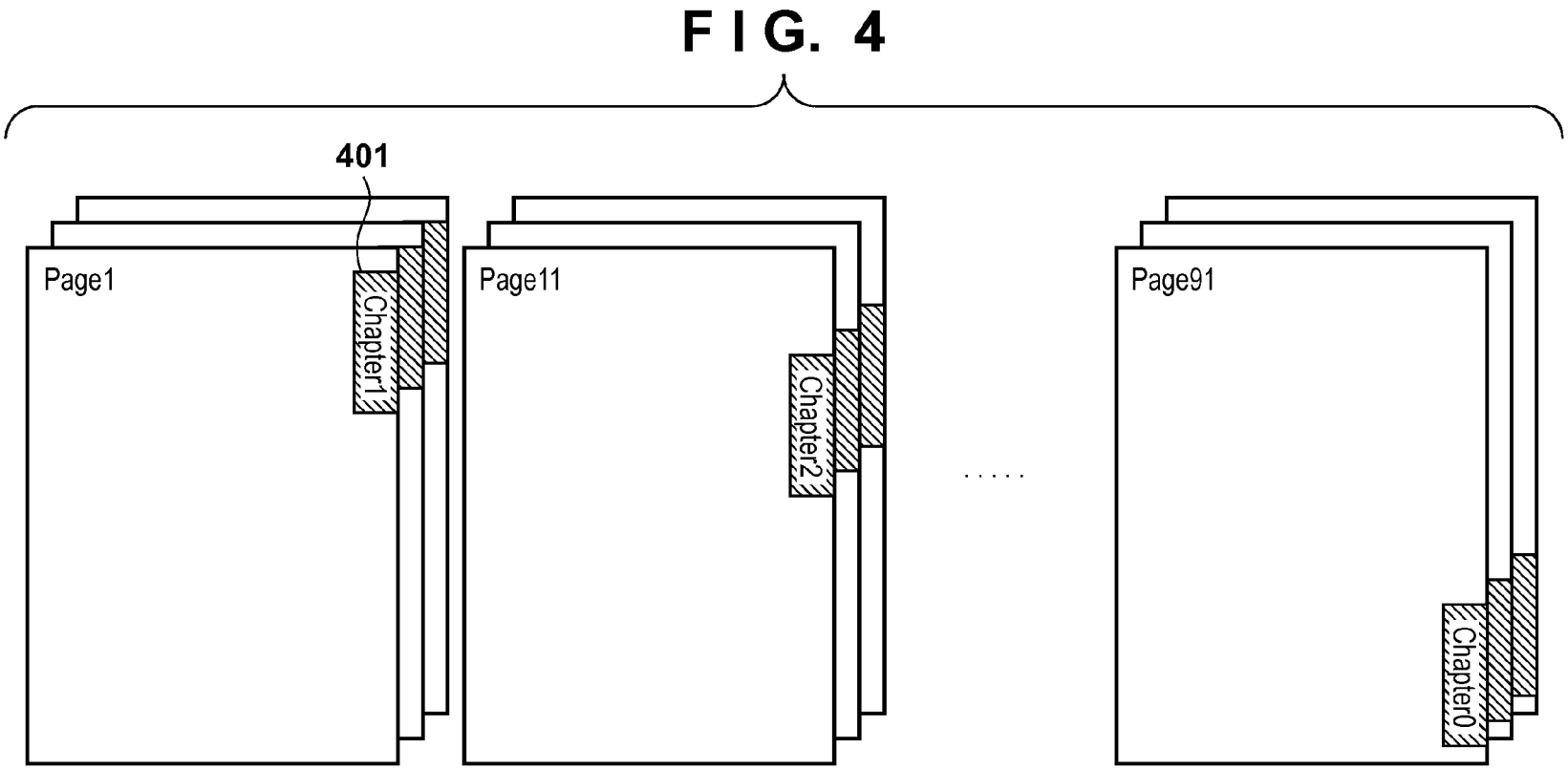
FIG. 4 is a diagram showing examples of printed items obtained through processing according to a first embodiment of the present invention.

The present embodiment will be described taking a job for printing a tab mark 401 on page edges as shown in FIG. 4 as an example of a job to be processed. Tab marks are printed on page edges of printed items such as an instruction manual or the like in order to provide easy visual indication of each chapter. The tab mark is printed across a plurality of pages. In the present embodiment, it is assumed that an instruction to output the tab mark on pages by using the same color (C, M, Y, K)=(40%, 40%, 50%, 10%) has been issued.

Figures 5, 6:
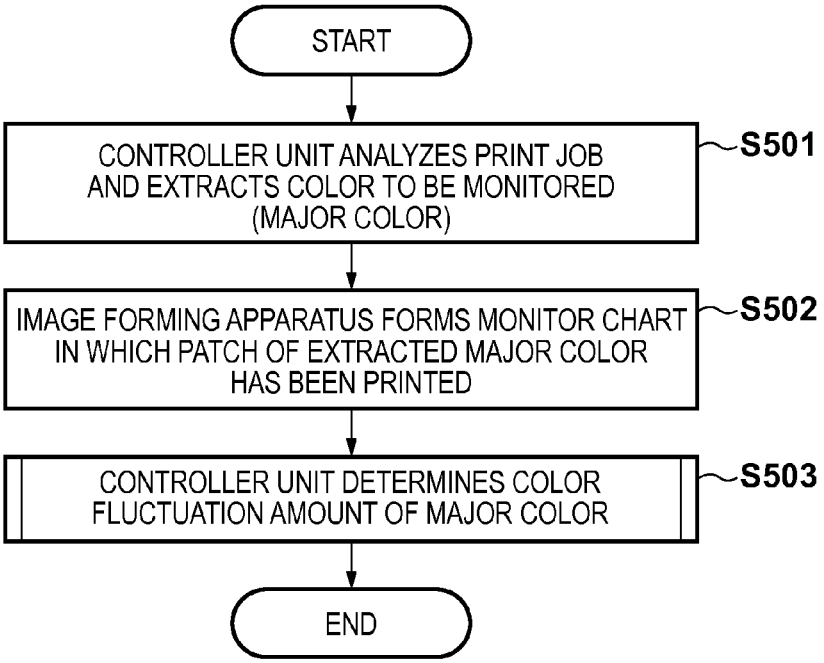
FIG. 5 is a diagram illustrating a main flowchart according to the first embodiment.
FIG. 6 shows a list of extracted colors (CMYK) according to the first embodiment.

FIG. 5 is a flowchart of processing according to the present embodiment. First, in step S501, the controller unit 201 analyzes a print job and extracts major colors having high use frequencies across a plurality of pages. The major colors (extracted colors) extracted in this step are to be monitored in the subsequent processing.

Next, in step S502, the image forming apparatus 100 forms a patch pattern of the major colors extracted in step S501.

Then, in step S503, the controller unit 201 determines the degree of fluctuations of the extracted major colors based on values obtained by measuring the patch pattern of the extracted major colors with a measurement device.

Figures 7, 8:
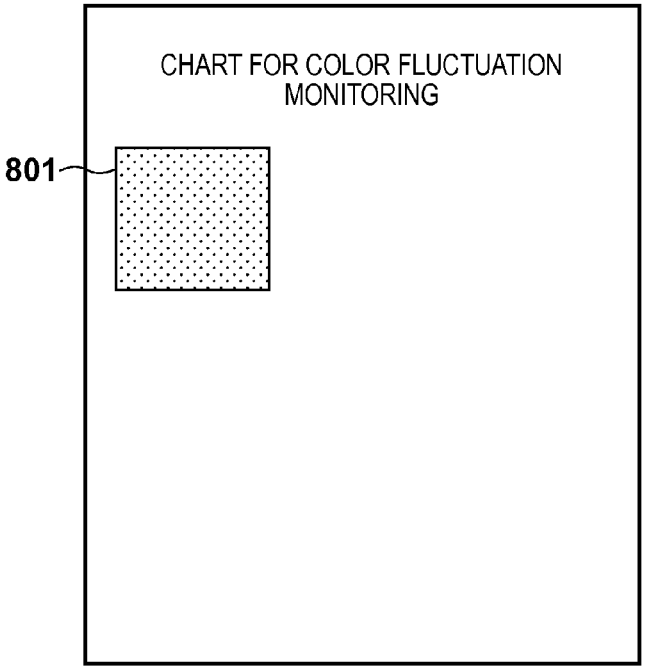
FIG. 7 shows a list of extracted colors (characteristic colors) according to the first embodiment.
FIG. 8 is a diagram showing an example of a patch pattern according to the first embodiment.

The processing of extracting major colors performed in step S501 will now be described in detail. The controller unit 201 searches for colors used in each page by analyzing the PDL (Page Description Language) of the print job and creates a list of the colors. For example, in the case of the colors of CMYK color space, the controller unit 201 creates a list as shown in FIG. 6. In this case, the colors that are likely to be commonly used such as (C, M, Y, K)=(0%, 0%, 0%, 100%) may be excluded from the search. It is of course possible to extract characteristic colors instead of the colors of CMYK color space. In the case of characteristic colors, the controller unit 201 creates a list as shown in FIG. 7.

Then, the controller unit 201 extracts major colors that satisfy a use frequency condition from the colors in the list. The use frequency condition can be, for example, "used in all pages". Referring to the list shown in FIG. 6, the color (C, M, Y, K)=(40%, 40%, 50%, 10%) used for the tab mark of the printed items of FIG. 4 satisfies the condition, and thus is extracted as a major color. The use frequency condition is not limited to "used in all pages", and may be "used at a predetermined percentage of pages or more" or "used in a predetermined number of pages or more". Specifically, for example, the condition may be "used in 80% of all pages" or "used in 20 pages or more", and may be designated by the user.

When creating a list, in FIG. 6, use frequency is determined by detecting whether or not a predetermined color is used in a page of interest. More specifically, if the amount of the predetermined color used in the page of interest (the range of region used by the color) is a predetermined value or less, the page of interest may be determined as a page that does not use the predetermined color. The predetermined value used to detect the used amount may be determined by taking the size of a logo mark to be printed or the like into consideration.

Next, the processing of forming a patch pattern of extracted colors performed in step S502 will be described in detail. First, the controller unit 201 obtains information about the measurement device that will measure the patch in step S503. The measurement device can be a scanner unit (not shown) connected to the device I/F 107, or the spectral sensor 42 provided in the image forming apparatus 100. Which measurement device is used from among these measurement devices may be defined uniquely according to the device configuration of the image forming apparatus 100 or may be selected by the user. In the present embodiment, the spectral sensor 42 is used as the measurement device.

Then, the controller unit 201 forms a patch pattern as shown in FIG. 8 according to the reading ability of the measurement device that measures the patch. The reading ability includes a minimum required patch interval, a minimum patch size or a patch position in the main scanning direction. For example, in the case of the spectral sensor 42, there are cases where a limited number of sensors are positioned in a limited location in the main scanning direction in the image forming apparatus 100. In this case, the controller unit 201 forms a patch pattern on paper using the image forming unit 203, taking the number of spectral sensors, the attachment location in the main scanning direction, a minimum patch size and minimum patch interval that can be read by the spectral sensors, and the like into consideration. The present embodiment uses a patch 801 having (C, M, Y, K)=(40%, 40%, 50%, 10%) used in the tab mark.

If a plurality of major colors have been extracted and a patch of the major colors does not fit into the patch forming region of a single page, the patch pattern may be formed to spread across a plurality of pages.

Figure 9:
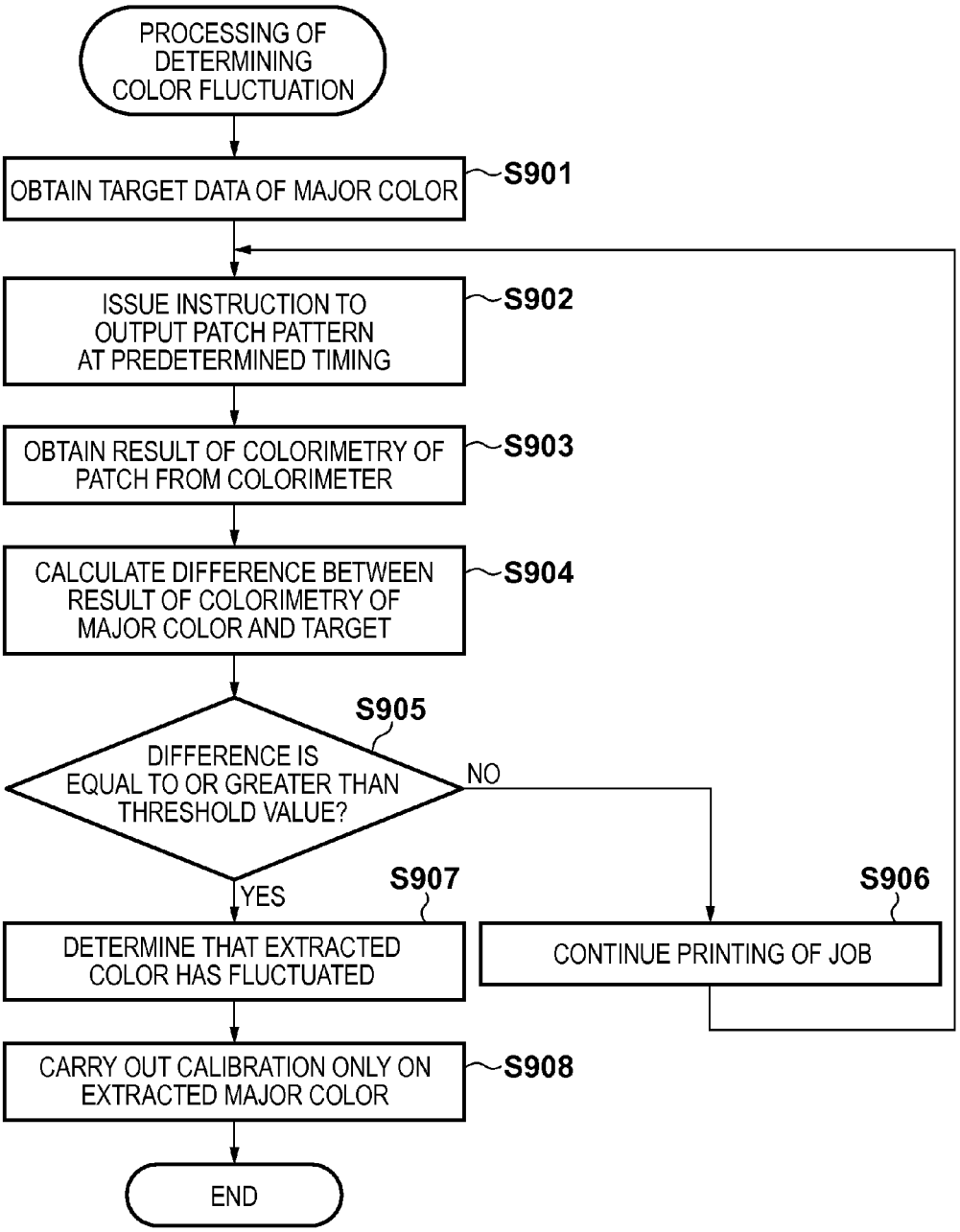
FIG. 9 is a diagram illustrating a flowchart of a color fluctuation degree determining unit according to the first embodiment.

Next, the processing of determining and correcting the degree of fluctuations of extracted colors performed by the controller unit 201 in step S503 will be described in detail with reference to FIG. 9. The flowchart illustrated below is executed by the CPU 102 executing a program loaded into the RAM 104 of the image forming apparatus 100.

First, in step S901, the controller unit 201 obtains target values that will be the reference values for extracted major colors. If the extracted major colors are the colors of CMYK space, the controller unit 201 obtains target L*a*b values from a CMYK—L*a*b conversion table of a device dependent output profile. At this time, if the extracted major colors are characteristic colors, the controller unit 201 refers to L*a*b values that have been defined for characteristic colors. The conversion table used here is assumed to be held in advance in, for example, the external storage unit 106 serving as a storage unit.

Next, in step S902, the controller unit 201 instructs the image processing unit 202 and the image forming unit 203 to output the patch pattern formed in step S502 at a predetermined timing. At this time, if the patch pattern is output during the job, the patch pattern is discharged to a discharge destination that is different from that for the print job, whereby it is possible to prevent the output of the job and the patch pattern from being mixed.

The predetermined timing mentioned above can be, but is not limited to, execution immediately before printing the job or at an interval of a predetermined number of pages. For example, if importance is placed on image quality rather than productivity, the predetermined timing may be controlled such that this processing is performed for each page.

Also, the controller unit 201 may control the timing at which an instruction to output a patch pattern is issued according to the page range used by the extracted major colors.

A case will be described in which in step S501, the condition for color extraction performed by the controller unit 201 is "used in 20 pages or more", as an example. If, for example, in a 100 page print job, one color is extracted as a major color and the extracted major color is used only in a range of 1 to 60 pages, there is no point in monitoring fluctuations of the color on page 61 and subsequent pages. If such a situation arises, the controller unit 201 can limit the patch pattern output instruction to be issued only during the time when pages 1 to 60 in which the extracted color is used are output. That is, in a print job, the range to be monitored may be limited based on the distribution of the use of major color in each page.

Then, in step S903, the controller unit 201 causes a colorimeter to read the patch pattern and obtains the result of the colorimetry. In the present embodiment, the spectral sensor provided in the image forming apparatus 100 is used, and therefore there is no need for the user to perform colorimetry. In the case where the reading apparatus is a scan unit, the controller unit 201 prompts the user to perform colorimetry on the output patch pattern with the scan unit via a display unit (not shown) provided in the operation unit 109.

In step S904, the controller unit 201 compares the target value obtained in step S901 and the colorimetric value obtained in step S903 and calculates the difference. In the present embodiment, ΔE, which is the general index representing a color difference, is used as the difference value, but the difference value is not limited thereto, and other indexes may be used.

In step S905, the controller unit 201 compares the difference (the amount of fluctuation) calculated in step S904 and a predefined threshold value.

As a result of the comparison, if the difference is less than the threshold value (No in step S905), the controller unit 201 continues printing of the job (step S906), and the procedure then returns to step S902.

If the difference is equal to or greater than the threshold value (Yes in step S905), then in step S907, the controller unit 201 determines that the extracted color has fluctuated.

After determining that the color has fluctuated, in step S908, the controller unit 201 carries out calibration only on the extracted color. The controller unit 201 corrects an N-dimensional color correction LUT in order to absorb the difference (the amount of fluctuation) calculated in step S904. A specific method of correction is not described here because it is not important in the present invention and a conventional technique can be used.

If in step S905 the difference is less than the threshold value, calibration is not carried out in step S908, but calibration may be consistently carried out after step S904 by omitting step S905 of determining the difference. Also, the results obtained from the calibration carried out in step S905 are reflected on from the output of the page printed by the image forming unit 203 at the aforementioned predetermined timing. Specifically, if the predetermined timing is "immediately before printing the job", steps S901 to S908 are executed before the job is printed. Then, after calibration has been carried out in step S908, the first and subsequent pages of the job on which the result of the calibration has been reflected are output. If the predetermined timing is "at page 5 of the job", steps S901 to S908 are executed after page 4 of the job has been printed. Then, after calibration has been carried out in step S908, the fifth and subsequent pages of the job on which the result of the calibration has been reflected are output.

Second Embodiment

Figure 10:
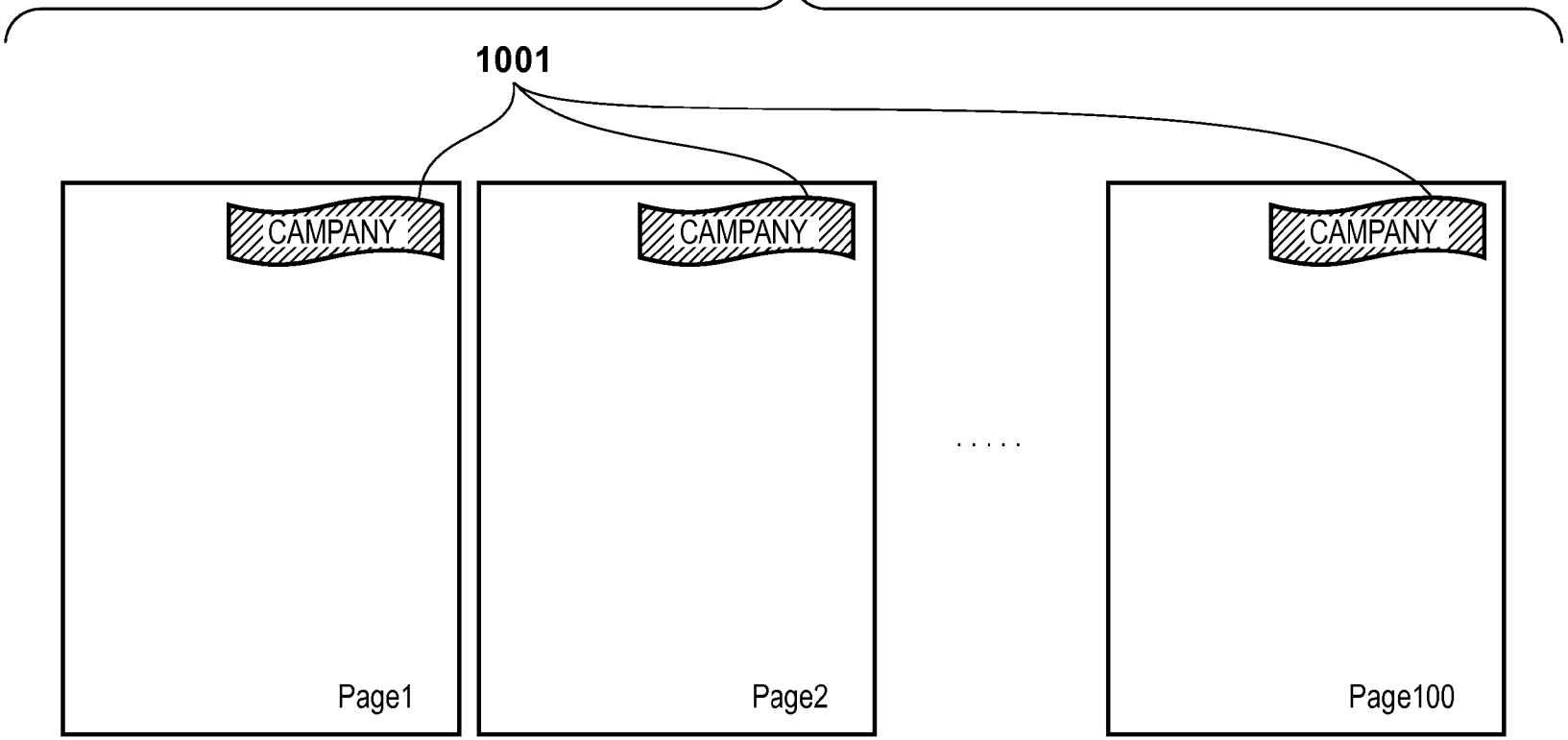
FIG. 10 is a diagram showing examples of printed items obtained through processing according to a second embodiment of the present invention.

Hereinafter, a second embodiment of the present invention will be described with reference to the drawings. The second embodiment will be described using a job for printing a logo 1001 on upper page edges as shown in FIG. 10 as an example of a job to be processed. Parts that overlap with those of the first embodiment will not be described here.

In the present embodiment, in the major color extraction processing in step S501 shown in FIG. 5, the controller unit 201 limits the search area to a specific area of a page. Then, the controller unit 201 searches for colors used in the print job. Generally, a logo as shown in FIG. 10 is often placed in upper or lower portions of pages. In the present embodiment, the position (extraction range) of an object that is to be monitored and corrected is limited in advance.

Figure 11A:
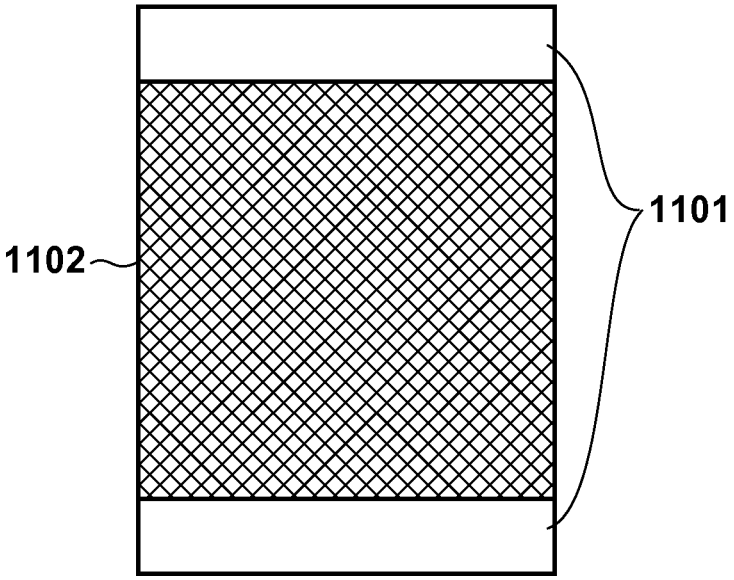
FIGS. 11A and 11B are diagrams showing an example of a color search range of a page according to the second embodiment.

Accordingly, in the present embodiment, as shown in FIG. 11A, the color search range is limited to an upper portion and a lower portion of a page.

Figure 11B:
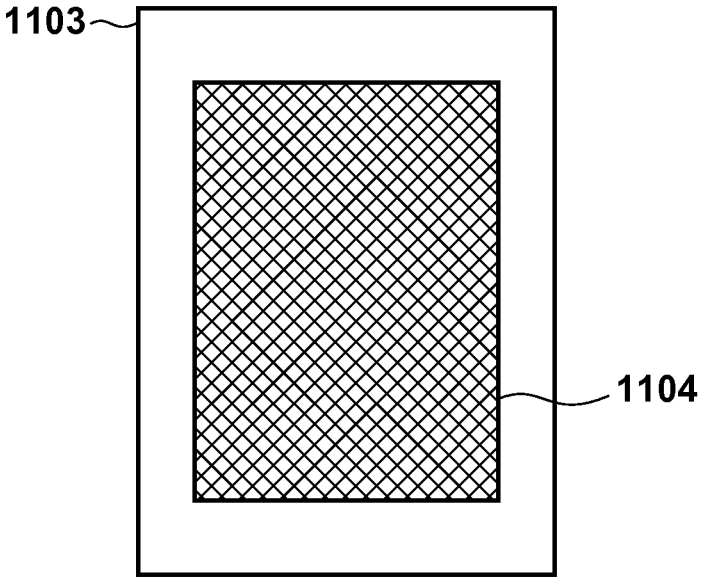

The controller unit 201 performs color search and major color extraction only within a color search range 1101 and does not perform color search within a non-search range 1102. The color search range is not limited to this example, and the color search range may be a certain range defined by four sides of a page as shown in FIG. 11B, in order to cope with printed items having a tab mark as used as an object to be processed in the first embodiment.

Also, in color search, the controller unit 201 may limit, in addition to the search range of a page, a target object. For example, only graphics and text included in rendering data are searched, and lines and image data may be excluded from the search. In other words, only objects having the aforementioned attributes of the object data included in PDL data are used as search targets, whereby the load during major color extraction can be reduced.

In VDP (Variable Data Printing) in which a variable data portion and a fixed data portion are present, only the fixed data portion that is repeatedly used across a plurality of pages may be used as a color search target.

The subsequent processing is the same as that of steps S502 and S503 described in the first embodiment, and thus a description thereof is omitted here.

As described above, the controller unit 201 efficiently limits the conditions for color search in order to extract major colors, as a result of which the time required by the controller unit 201 to extract major colors can be shortened, and the processing load can be reduced. Therefore, according to the present invention, the degradation of productivity can be reduced.

Third Embodiment

Hereinafter, a third embodiment of the present invention will be described with reference to the drawings. Parts that overlap with those of the first and second embodiments will not be described here.

Figure 12:
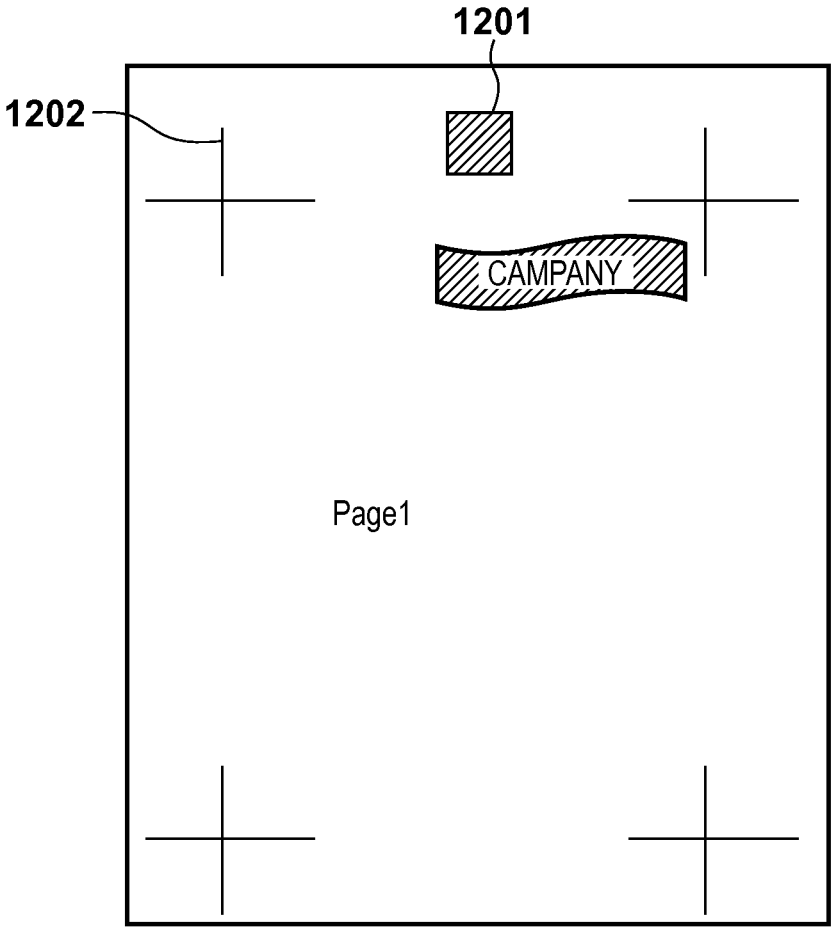
FIG. 12 is a diagram showing an example of a patch pattern output method according to a third embodiment of the present invention.

In the present embodiment, in step S502 shown in FIG. 5, the image forming apparatus 100 prints a patch of colors extracted in step S501 in a margin region of the print job as indicated by a patch 1201 of FIG. 12.

In the POD market, there is a job that requires finishing processing on print copies after the job has been printed. Cutting is one of the finishing processing, and by cutting the printed items by using the positions of crossmarks 1202 that have been printed on paper as a guide, the printed items can be sized. That is, even when the patch 1201 of extracted major colors is printed on a margin region that exists at the time of printing, the martin region is cut in the finishing processing, and thus the printed items are not affected.

As described above, by printing a patch in the margin region of a print job and performing colorimetry at the time of execution of the job, it is possible to avoid the consumption of paper only for determining and correcting color fluctuations. Also, there is no need to interrupt the print job and output a chart for determining color fluctuations, and therefore the color quality of major colors can be maintained without reducing the productivity of the image forming apparatus 100. Furthermore, the margin region in which the patch has been formed is cut after printing, and it is therefore possible to determine and correct color fluctuations without affecting the printed items.

Fourth Embodiment

A fourth embodiment of the present invention will be described below with reference to the drawings. Pars that overlap with those of the first to third embodiments will not be described here.

In the first to third embodiments, the output of a patch pattern, determination of the degree of color fluctuation and correction processing are carried out during the output of a single copy, but the present invention is not limited thereto, and even when the print job is output in a plurality of copies as well, the determination of color fluctuation and correction processing may be carried out at a predetermined timing.

The present embodiment will be described taking an example in which 100 copies of a two-page print job are printed, with reference to FIG. 13.

Figure 13:
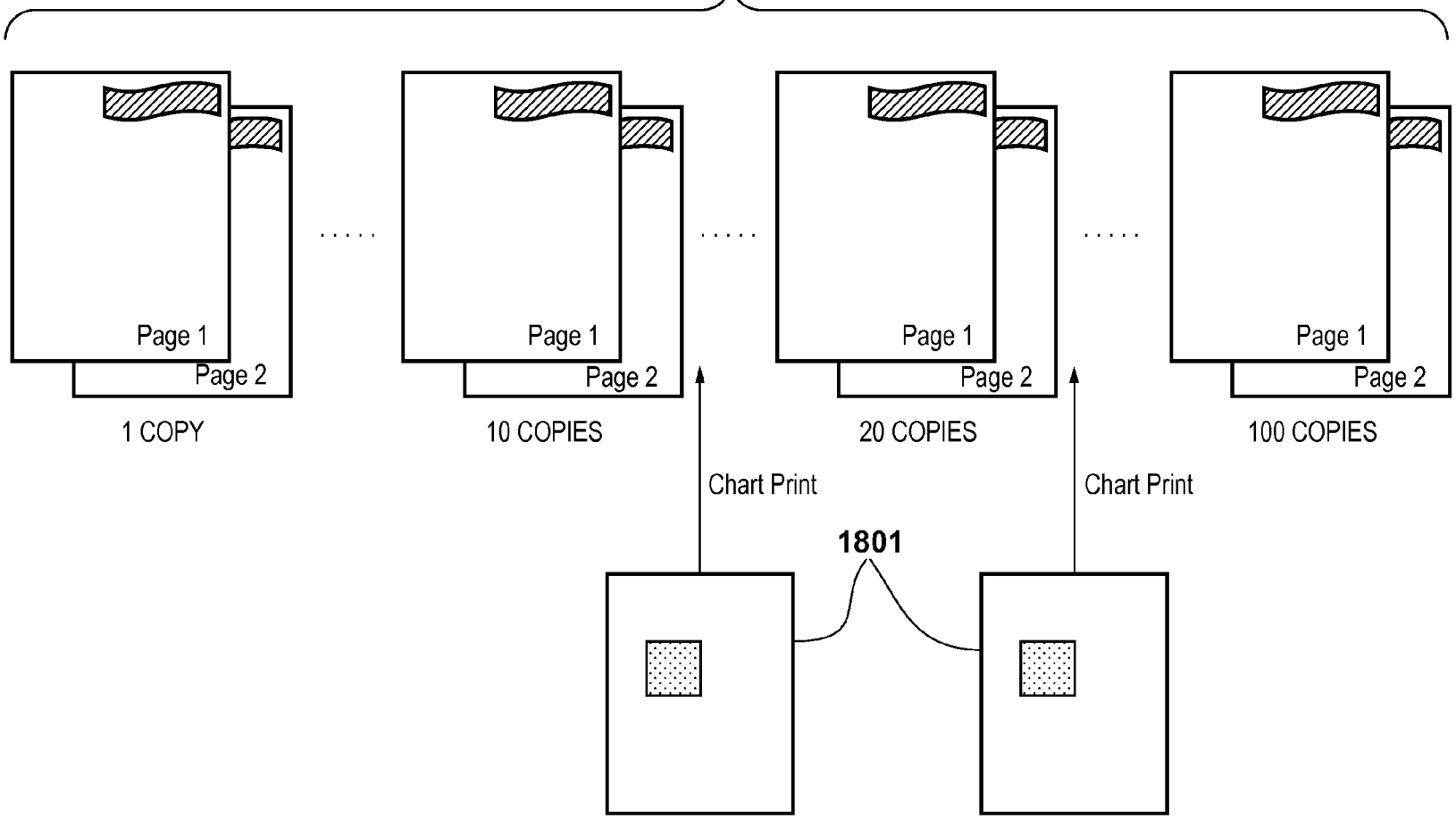
FIG. 13 is a diagram showing examples of printed items obtained through processing according to a fourth embodiment of the present invention.

In the case where a job as shown in FIG. 13 is printed in a single copy, it is less likely that color fluctuation occurs during the output of only two pages, so there is little need to determine the degree of color fluctuation. However, in the case where such a job is printed in 100 copies, it is highly likely that color fluctuation occurs between copies.

In order to suppress such color fluctuation between copies, for example, for each 10 copies, the controller unit 201 carries out output of a patch pattern 1801 of extracted colors and determination processing for the degree of color fluctuation or carries out correction processing for the fluctuation.

As described above, in the case where a print job is output in a plurality of copies, the processing of determining color fluctuation and correcting the color fluctuation are carried out at a predetermined timing. The predetermined timing used here is an interval of a predetermined number of copies. In the case where a print copy has a predetermined number of pages or less, and the number of copies is a predetermined number or more, the processing may be performed by the unit of a plurality of copies shown in the present embodiment. Also, the determination and correction processing may be performed by determining an interval of a predetermined number of copies according to the total page number of the plurality of copies.

As described above, according to the present embodiment, color fluctuation when a job including a few pages is output in a large number of copies can also be reduced.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-152343, filed Jul. 8, 2011, which is hereby incorporated by reference herein in its entirety.

What is claimed is:

1. An image forming apparatus comprising:

an image forming unit configured to form an image;

an extraction unit that analyzes an input print job and extracts a color used in pages more than a threshold value of a plurality of pages constructing the print job;

a patch image forming unit configured to form, by the image forming unit, a patch image of the color extracted by the extraction unit;

a determining unit configured to measure the patch image formed by the patch image forming unit and to determine an amount of color fluctuation from a reference value for the extracted color; and a correction unit configured, when printing an image included in a page constructing the input print job by the image forming unit, to correct the extracted color by using the amount of color fluctuation determined by the determining unit, wherein a timing at which the patch image is formed by the patch image forming unit and a timing at which the amount of color fluctuation of the extracted color is determined by the determining unit are determined using information about the number of pages of and information about the number of copies of the input print job.

2. The image forming apparatus according to claim 1, wherein the extraction unit extracts the color from a designated range of the input print job.

3. The image forming apparatus according to claim 1, wherein the extraction unit limits attributes of an object that is included in a page and from which color extraction is performed.

4. The image forming apparatus according to claim 1, wherein the determining unit carries out the determination before an image included in a page constructing the input print job is printed by using the image forming unit.

5. The image forming apparatus according to claim 1, wherein the patch image forming unit forms the patch image at an interval of a predetermined number of pages.

6. The image forming apparatus according to claim 1, wherein the patch image forming unit forms the patch image in a margin region of a page, and the determining unit determines the amount of color fluctuation of the extracted color using the patch image formed in the margin region when forming an image included in a page constructing the input print job by the image forming unit.

7. The image forming apparatus according to claim 1, wherein the patch image forming unit determines a timing at which the patch image is formed, according to distribution of pages in which the extracted color is used.

8. The image forming apparatus according to claim 1, wherein measuring of the patch image formed by the patch image forming unit is performed by a sensor arranged along a conveyance path extending from where paper of the image forming apparatus is subjected to fixing to where the paper is discharged.

9. An image forming method comprising:

analyzing an input print job and extracting a color used in pages more than a threshold value of a plurality of pages constructing the print job;

forming, by using an image forming unit, a patch image of the color extracted in the extraction step;

measuring the patch image formed in the forming step and determining an amount of color fluctuation from a reference value for the extracted color; and when printing an image included in a page constructing the input print job by using the image format unit, correcting the extracted color by using the amount of color fluctuation determined in the determining step, wherein a timing at which the patch image is formed in the forming step and a timing at which the amount of color fluctuation of the extracted color is determined in the determining step are determined using information about the number of pages of and information about the number of copies of the input print job.

10. A non-transitory computer-readable medium storing a program for causing a computer to function as:

an image forming unit configured to form an image;

an extraction unit configured to analyze an input print job and extracts a major color used in pages more than a threshold value of a plurality of pages constructing the print job;

a patch image forming unit configured to form, by the image forming unit, a patch image of the color extracted by the extraction unit;

a determining unit configured to measure the patch image formed by the patch image forming unit and to determine an amount of color fluctuation from a reference value for the extracted color; and a correction unit configured, when printing an image included in a page constructing the input print job by the image forming unit, to correct the extracted color by using the amount of color fluctuation determined by the determining unit, wherein a timing at which the patch image is formed by the patch image forming unit and a timing at which the amount of color fluctuation of the extracted color is determined by the determining unit are determined using information about the number of pages of and information about the number of copies of the input print job.

* * * * *